US010033115B2

(12) United States Patent
Bao et al.

(10) Patent No.: US 10,033,115 B2
(45) Date of Patent: Jul. 24, 2018

(54) ACTIVE ANTENNA

(71) Applicant: Telefonaktiebolaget L M Ericsson (publ), Stockholm (SE)

(72) Inventors: Mingquan Bao, Västra Frölunda (SE); Yinggang Li, Askim (SE); Bing Zhang, Göteborg (SE)

(73) Assignee: Telefonaktiebolaget LM Ericsson (Publ), Stockholm (SE)

( * ) Notice: Subject to any disclaimer, the term of this patent is extended or adjusted under 35 U.S.C. 154(b) by 57 days.

(21) Appl. No.: 14/777,554

(22) PCT Filed: Mar. 21, 2013

(86) PCT No.: PCT/EP2013/055942
§ 371 (c)(1),
(2) Date: Sep. 16, 2015

(87) PCT Pub. No.: WO2014/146715
PCT Pub. Date: Sep. 25, 2014

(65) Prior Publication Data

US 2016/0072197 A1 Mar. 10, 2016

(51) Int. Cl.
*H01Q 1/50* (2006.01)
*H01Q 23/00* (2006.01)
*H01Q 7/00* (2006.01)

(52) U.S. Cl.
CPC ..... *H01Q 23/00* (2013.01); *H01Q 7/00* (2013.01)

(58) Field of Classification Search
CPC ..... H01Q 5/00; H01Q 5/004; H01Q 9/145; H01Q 9/30

(Continued)

(56) References Cited

U.S. PATENT DOCUMENTS

2005/0151690 A1* 7/2005 Minemura ..... H01Q 1/243 343/702
2013/0278473 A1* 10/2013 Bowers ..... H01Q 11/04 343/732

FOREIGN PATENT DOCUMENTS

GB 2310320 A 8/1987

OTHER PUBLICATIONS

Forster, E., "A New Approach to the Design of a BroadBand Active Loop Antenna 50 kHz - 30 MHz", IEE Colloquium on Electrically Small Antennas, Oct. 23, 1990, pp. 4/1-4/2, IET, London, GB.

(Continued)

*Primary Examiner* — Dameon E Levi
*Assistant Examiner* — Collin Dawkins
(74) *Attorney, Agent, or Firm* — Patent Portfolio Builders, PLLC

(57) ABSTRACT

An active antenna (100, 200, 300) comprising a driving loop with first (103) and second (105) sections, each of which extends between end points. Each end point of each section (103, 105) is connected to the closest end point of the other section by a reflection amplifier (101, 106). One reflection amplifier (106) comprises differential ports for signals to/from the active antenna. The active antenna also comprises a passive loop with first (107) and second (108) sections, each of which extends between end points. Each end point of each section (107, 108) is connected to the closest end point of the other section by a reflection amplifier (102, 104). The driving loop and the passive loop extend in parallel to each other and the first and the second section (103, 105; 107, 108) of each of the loops form separated complementary parts of a closed geometrical shape and are built in open waveguide technology.

12 Claims, 12 Drawing Sheets

(58) Field of Classification Search
USPC ..... 343/850, 722, 745, 814
See application file for complete search history.

(56) References Cited

OTHER PUBLICATIONS

Chung-Tse, M., et al. "A high gain active antenna array using dual-fed distributed amplifier-based CRLH-Leaky wave antennas", 2012 Asia-Pacific Microwave Conference Proceedings (APMC), Dec. 4, 2012, pp. 136-138, IEEE.

* cited by examiner

Azimuth angle: 0°

Azimuth angle: 90°

ACTIVE ANTENNA

TECHNICAL FIELD

The present invention discloses an improved active antenna.

BACKGROUND

Active antennas are antennas which comprise amplifiers. One known design of an active antenna is a do called distributed amplifier-based active antenna, in which amplifiers which comprise transistors are fed by input signals via a transmission line. In such a design, resistive losses in the transmission line are unavoidable, and the longer the transmission line is, the more losses the transmission line will have. In addition to this, spurious radiation exists from the transmission line, which may damage the radiation pattern of the active antenna and increase the power losses.

SUMMARY

It is an object to obtain an improved active antenna which obviates at least some of the disadvantages mentioned above.

This object is obtained by means of an active antenna which comprises a driving loop with a first and a second section, each of which sections extends between two end points. Each end point of each section is electrically connected to the closest end point of the other section by means of a reflection amplifier, and one of said reflection amplifiers comprises differential input/output ports for signals to/from the active antenna.

The active antenna also comprises a passive loop with a first and a second section, each of which sections extends between two end points. Each end point of each section is electrically connected to the closest end point of the other section by means of a reflection amplifier.

In the active antenna, the driving loop and the passive loop extend in parallel to each other, and the first and the second section of each of the loops form separated complementary parts of a closed geometrical shape and are built in open waveguide technology.

In embodiments of the active antenna, the sections of the driving loop are located on alternating sides of the sections of the passive loop, i.e. with one part on the outside of one of the sections of the passive loop and with another part on the inside of the other section of the passive loop.

In embodiments of the active antenna, the two sections of the driving loop are located on one and the same side of the two sections of the passive loop.

In embodiments of the active antenna, the driving loop and the passive loop are arranged to have their signals in-phase or to have a phase difference of 180 degrees between their signals.

In embodiments of the active antenna, the driving loop and the passive loop are arranged to have a phase difference of 90 degrees between their signals.

In embodiments of the active antenna, the driving loop and the passive loop are connected to each other by means of a first amplifier which connects the first sections of the two loops and a second amplifier which connects the second sections of the two loops.

In embodiments of the active antenna, the first and the second amplifiers are both arranged to amplify in the same direction i.e. from the driving loop to the passive loop or from the passive loop to the driving loop.

In embodiments of the active antenna, the first and the second amplifiers are arranged to amplify in different directions, i.e. one of the amplifiers is arranged to amplify from the driving loop to the passive loop and the other amplifier is arranged to amplify from the passive loop to the driving loop.

In embodiments of the active antenna, the two sections of the first and second loop are L-shaped, thus giving each section two legs.

In embodiments of the active antenna, both legs of the L of the two sections are of equal lengths.

BRIEF DESCRIPTION OF THE DRAWINGS

The invention will be described in more detail in the following, with reference to the appended drawings, in which.

DETAILED DESCRIPTION

Figure 1:
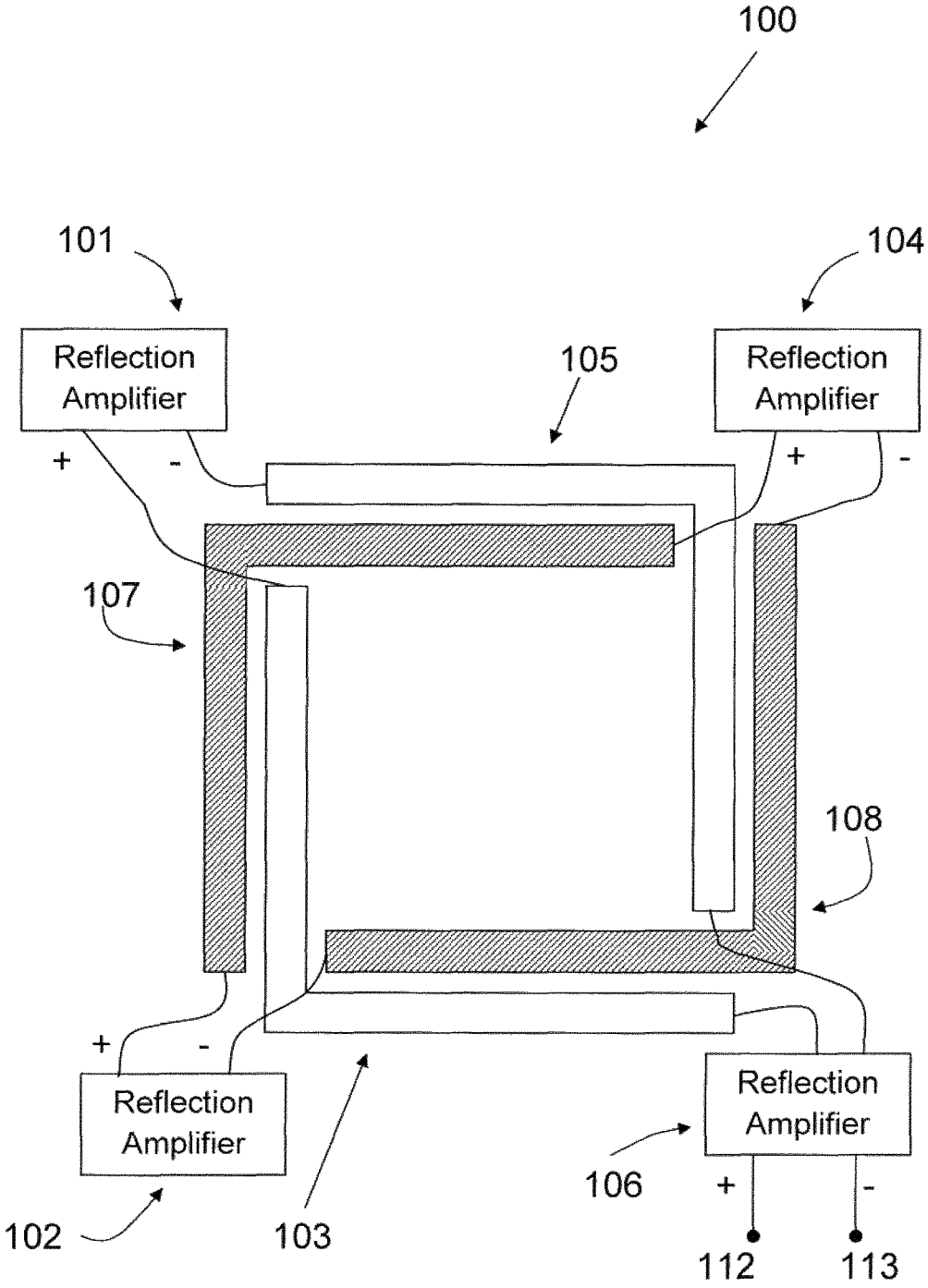
FIGS. 1 and 2 show embodiments of an active antenna.

Embodiments of the present invention will be described more fully hereinafter with reference to the accompanying drawings, in which embodiments of the invention are shown. The invention may, however, be embodied in many different forms and should not be construed as being limited to the embodiments set forth herein. Like numbers in the drawings refer to like elements throughout.

FIG. 1 shows an embodiment 100 of an active antenna. The embodiment 100 comprises four sections 103, 105, 107, 108, which are designed in open waveguide technology. The term "open waveguide technology" is here used to refer to technologies which comprise at least one conducting strip and one ground plane or ground trace, such as e.g. strip-line, microstrip and coplanar waveguides, as opposed to "closed waveguide technology", which comprise waveguides with a closed cross-section, e.g. a rectangular, circular or elliptical cross-section.

The four sections 103, 105, 107 and 108 are arranged to pair-wise form loops of the active antenna, so that the sections 103 and 105 form one loop and the sections 107 and 108 form another loop.

In the drawings and in the following, the four sections 103, 105, 107, 108 of the embodiment 100 will be shown and described as being L-shaped, i.e. as forming a line with a 90-degree bend, where the two sections of each loop, i.e. 103-105 and 107-108 respectively, "face each other", so that the two L-shaped sections of each loop constitute separated halves of a closed geometrical shape, in this case a square. It should be pointed out that the closed geometrical shape of which the two sections in each loop form separated halves need not be a square: other shapes of the sections than the L-shape are also possible, by means of which other closed geometrical shapes are also possible, e.g. circles and ellipses, formed by sections which are shaped as semi-circles or semi-rectangles.

The two sections comprised in each loop are electrically connected to each other in the following manner: each section 103, 105, 107 and 108 extends between two end points, in this case the two end points of their respective L. The end points of the sections in each pair which are the closest to each other are electrically connected to each other by means of a reflection amplifier which connects the two end points to each other. Thus, in the passive loop, the end points in the sections 107, 108, which are the closest to each other are connected by means of respective reflection amplifiers 102 and 104, and in the driving loop, the end points in the sections 103, 105, which are the closest to each other are connected by means of respective reflection amplifiers 101 and 106. It should be mentioned that the connections from said end points to the reflection amplifiers are not drawn to scale in FIG. 1: the connections from two end points to an amplifier should be of equal lengths.

Figure 10:
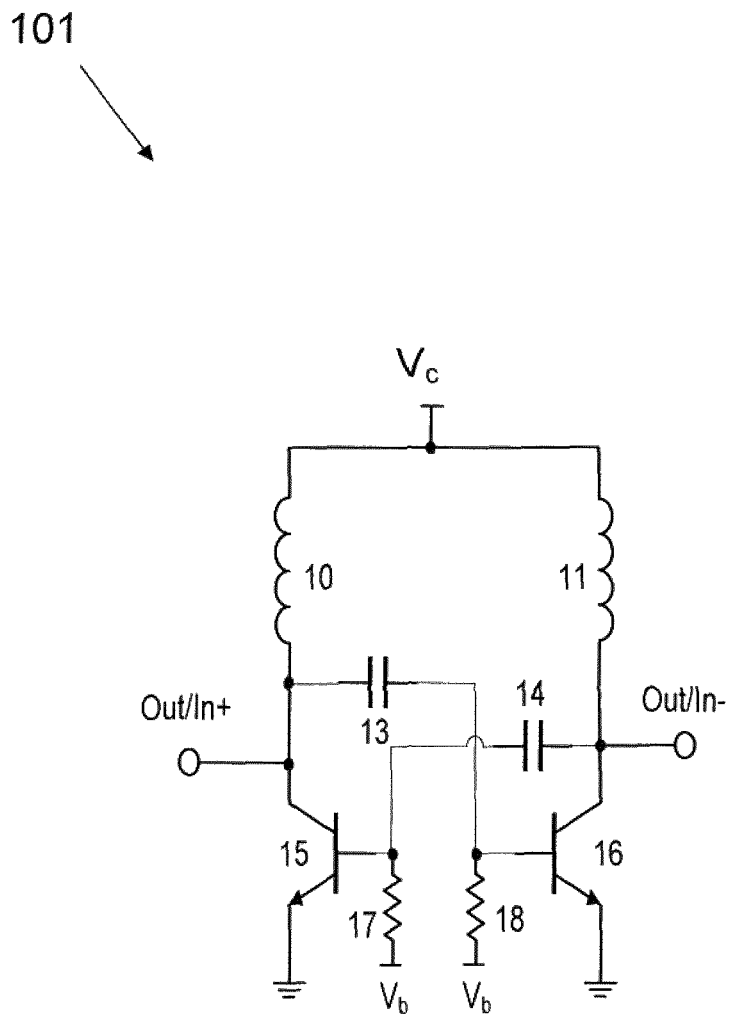

The term "reflection amplifier" is here used to denote an amplifier with two ports and which is arranged to receive an input signal at either of the two ports and to deliver it as an amplified output signal at the other port. An example of an embodiment of a reflection amplifier will be given later in this text, and is shown in FIG. 10. However, in brief, a reflection amplifier thus differs from an ordinary amplifier in that the reflection amplifier has the feature that it can amplify in either direction, i.e. regardless of which port that a signal is received at, an amplified signal will be output at the other port.

One pair of the sections of the active antenna 100 constitutes a driving loop and the other pair constitutes a passive loop. In the embodiment shown in FIG. 1, the section pair which constitutes the driving loop comprises the two sections 103 and 105, and the section pair which constitutes the passive loop comprises the two sections 107 and 108. The loop formed by the two sections 103, 105, is arranged to constitute a driving loop by virtue of the fact that one of the reflection amplifiers used to connect the two sections in the loop, in this case the reflection amplifier 106, comprises differential input/output ports 112, 113, for signals to/from the active antenna 100. Thus, at these ports, a signal can be input which excites the sections 103, 105, of the driving loop, said signal being a transmit signal. The active antenna 100 is reciprocal, i.e. signals which are received by the active antenna can also be accessed at the ports 112, 113, but the active antenna 100 will here be described in terms of transmission.

If a transmit signal is input at the ports 112, 113, the driving loop will thus be excited by this signal, while the passive loop will be connected to the driving loop by means of capacitive coupling between adjacent sections of the driving loop and the passive loop, which will give rise to a weaker signal in the passive loop than in the driving loop. This difference in signal strengths can however be overcome by means of letting the reflection amplifiers 102, 104, which connect the sections of the passive loop to each other have a higher gain than the reflection amplifiers 101, 106 which connect the sections of the driving loop to each other. The gain difference depends on the strength of the electromagnetic coupling between the two loops, but a suitable difference is in the range of 5-8 dB.

Figure 2:
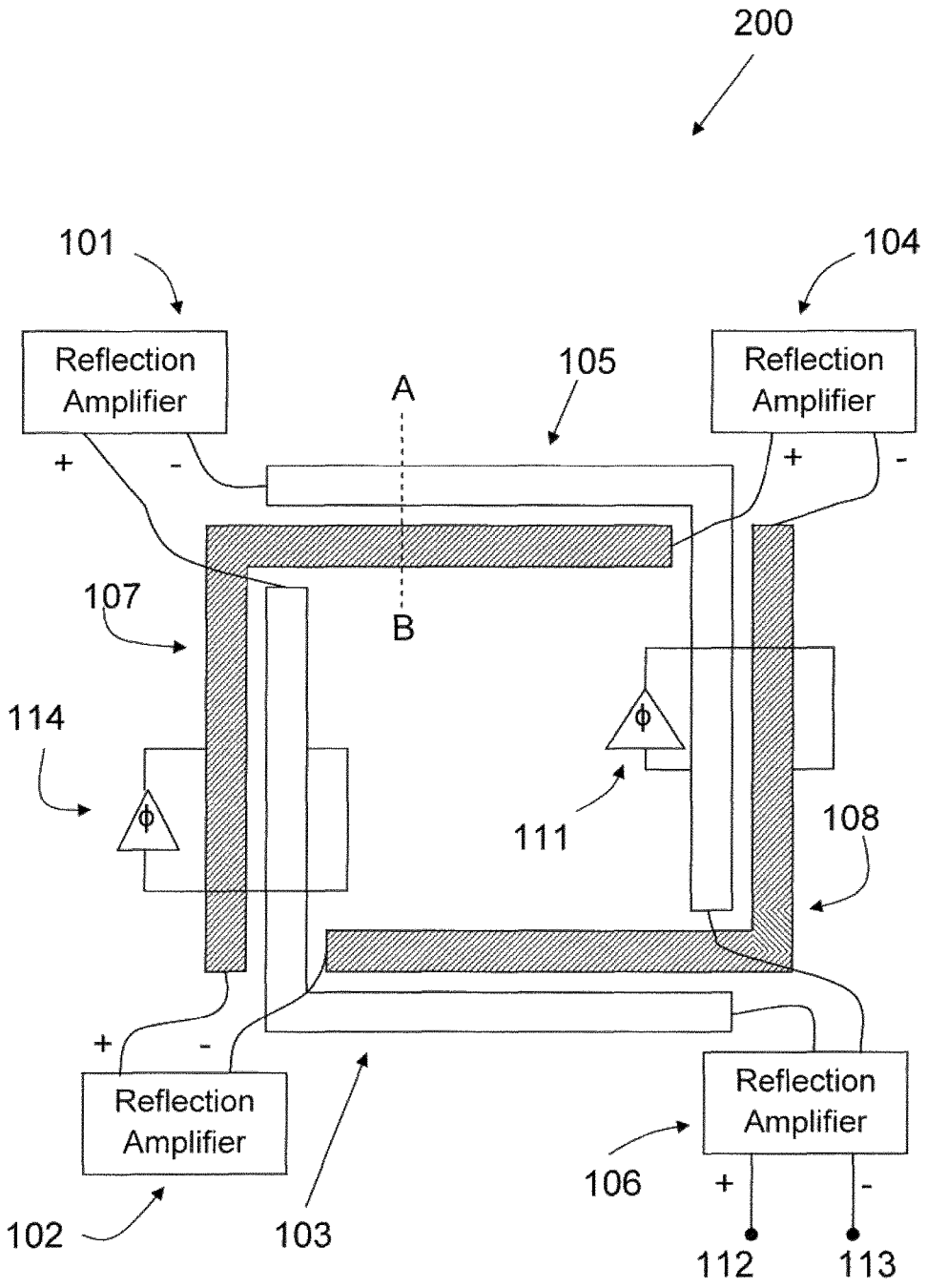

The active antenna shown in FIG. 1 will have a polarization which is a mixture of linear and circular. If it is desired to achieve an active antenna which has solely linear or circular polarization, this can be accomplished by means of locking the phase difference between the signals in the two loops, suitably by means of connecting the two loops to each other by means of phase shifters. This will be described with reference to an embodiment 200 shown in FIG. 2: the active antenna 200 shown in FIG. 2 is based on the one in FIG. 1, but also comprises phase shifters 111, 114, which each connect one section of each loop to one section of the other loop: as shown in FIG. 2, the phase shifter 111 connects the section 105 of the active loop to the section 108 of the passive loop, and the phase shifter 114 connects the section 103 of the active loop to the section 107 of the passive loop. Also shown in FIG. 2 are two points, A and B, one in each loop, in order to explain what is meant by the phase differences: the phase difference mentioned here is the difference in phase between the signals in adjacent points in the two loops, such as the points A and B.

If it is desired to give the active antenna 200 of FIG. 2 a linear polarization, the phase shifters 111, 114 should be arranged to cause a phase difference of 0° or 180° between the active and the passive loops, whilst, if it is desired to give the active antenna 200 a circular polarization, the phase shifters 111, 114 should be arranged to cause a phase difference of 90° between the active and the passive loops. Naturally, the same effect can be caused by a plurality of phase shifters between the loops.

Regarding the reflection amplifiers, as mentioned, they can be used to equalize the power between the two loops. Another way of equalizing the power between the driving loop and the passive loop is to connect the loops by means of amplifiers which amplify signals from the driving loop to the passive loop. Such amplifiers are then suitably incorporated into one and the same component as the phase shifters 111, 114, so that each of the components 111, 114, become amplifiers with a phase shift. Regarding the direction of amplification, this is shown in FIG. 2 as being from the active to the passive loop, but the other direction can also be used i.e. from the passive to the active loop, all depending on which effects it is desired to obtain. In embodiments, one amplifier can amplify in one direction and the other amplifier in the other direction, again, all depending on which effects it is desired to obtain.

Turning now to how the sections 103, 105, 107 and 108 of the driving loop and the passive loop are arranged geometrically in the embodiments shown in FIGS. 1 and 2, this is as follows, as can also be seen in FIGS. 1 and 2: each of the two sections of each loop is interlaced or interwoven with the two sections of the other loop, so that, for example, the section 107 of the passive loop extends with one part on the inside of the section 105 of the driving loop and with a second part, the section 107 of the passive loop extends on the outside of the section 103 of the driving loop. Similarly, the section 108 of the passive loop extends with one part on the outside of the section 105 of the driving loop and with a second part, the section 108 of the passive loop extends on the inside of the section 103 of the driving loop.

This can be generalized as saying that the sections 103, 105, of the driving loop are located on alternating sides of the sections, 107, 108, of the passive loop, i.e. with one part on the outside of one of the sections of the passive loop and with another part on the inside of the other section of the passive loop.

The term "inside" and "outside" of the sections as used above refers to the fact that, as noted, each the two sections of a loop will have a shape which is "non-straight", e.g. L-formed, semi-circular etc, so that there will be an inside and an outside of each section. In the case of L-formed sections, each section will have two "legs", and it is these legs that are interwoven, by virtue of the fact that the L-shaped sections 107, 108, of the passive loop are rotated 90 degrees with respect to the L-shaped sections 103, 105, of the driving loop.

Figure 3:
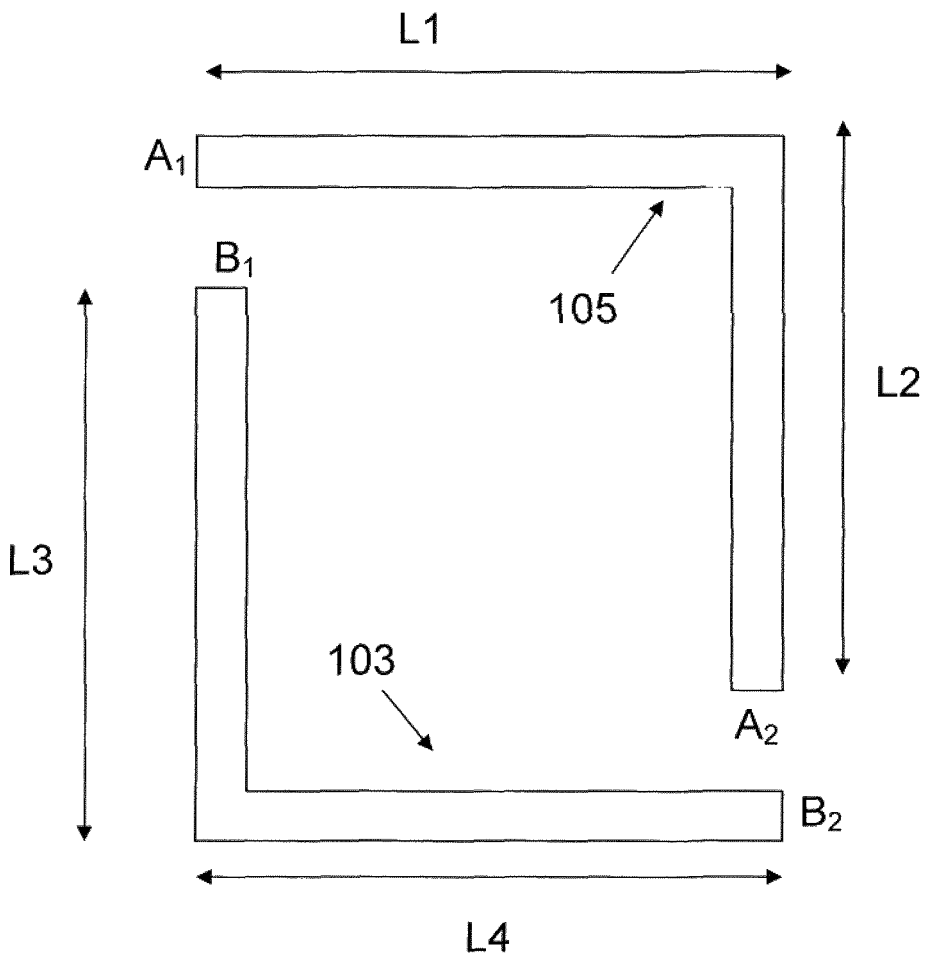
FIGS. 3 and 4 show dimensions of components of the embodiment of FIG. 1.

FIG. 3 shows the sections of the active loop antennas 100, 200, and is intended to illustrate the dimensions involved:

each section 103, 105, is shown with its two legs, i.e. L1, L2, for the section 105, and L3, L4 for the section 103. An observation to be made here is that opposing legs do not need to be of the same length, i.e. the L1 and L4 do not need to be of the same length nor do L3 and L2, but the two sections as such do need to be of equal lengths, so that L3+L4=L1+L2. FIG. 3 also shows the end points mentioned previously of each section: thus the section 103 extends between end points $B_1$ and $B_2$, and the section 105 extends between end points $A_1$ and $A_2$.

Figure 4:
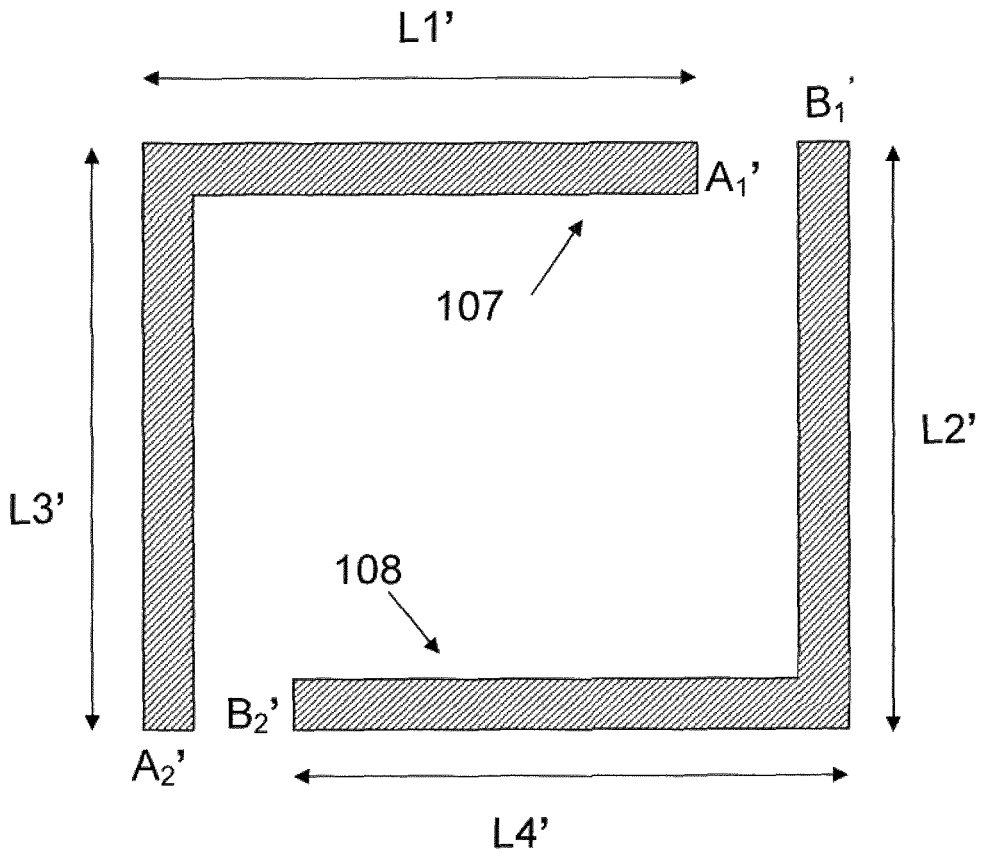

FIG. 4 shows a figure similar to the one of FIG. 3, but shows the sections 107, 108, of the passive loop. Although the reference numbers and letters used in FIG. 4 differ from those of FIG. 3, all observations made regarding the dimensions etc of the sections of the driving loop in connection to FIG. 3 are valid for FIG. 4 as well. In addition, the lengths of the sections 107, 108, of the passive loop should be equal to the lengths of the sections 103, 105, of the driving loop.

Figure 5:
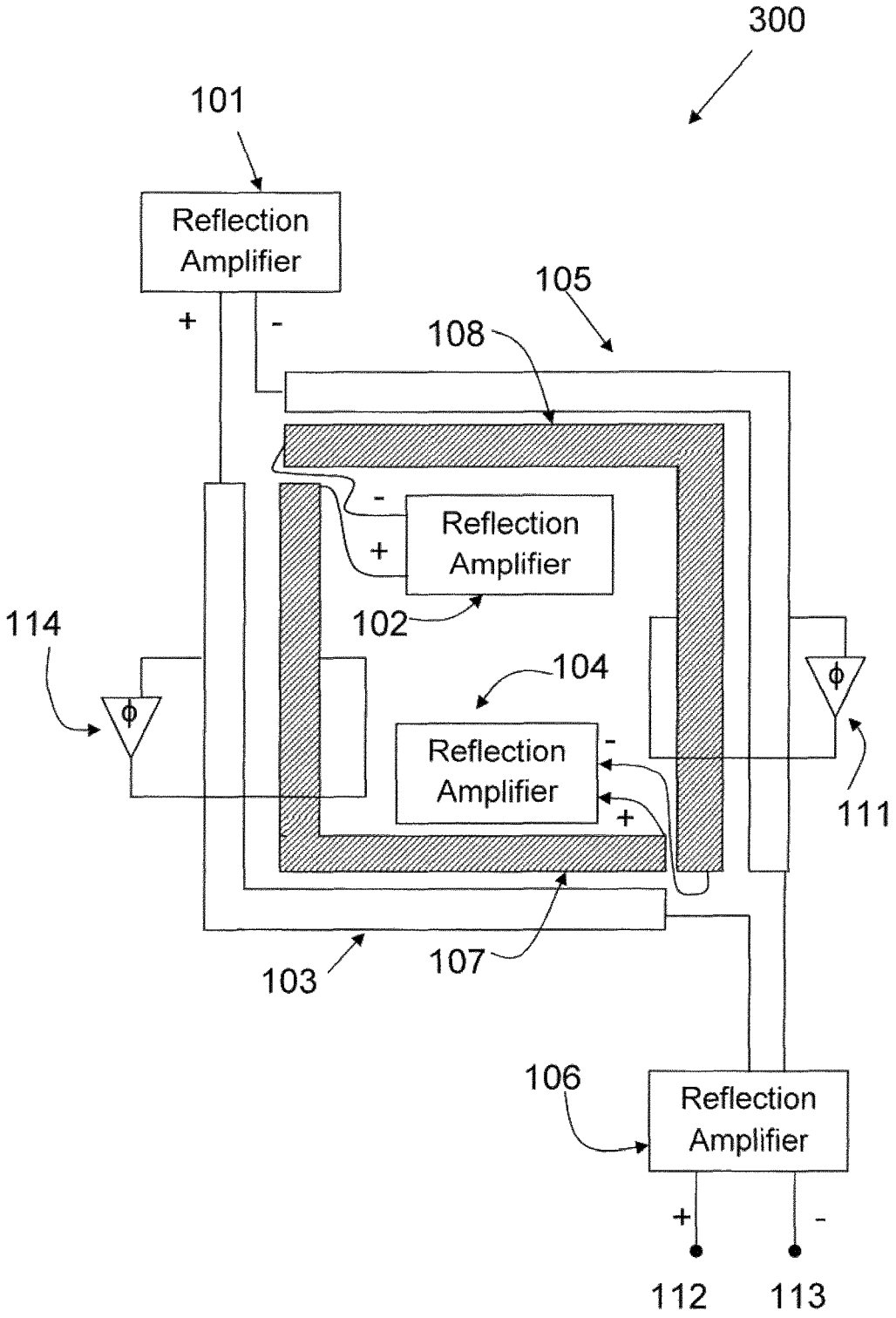
FIG. 5 shows an embodiment of an active antenna.

FIG. 5 shows a further embodiment 300 of an active antenna. Due to the similarities between the active antenna 300 and the ones 100, 200, reference numbers used in FIGS. 1 and 2 will also be used in FIG. 5 to refer to like components. However, a difference between the embodiment 300 and the ones 100, 200 shown in FIGS. 1 and 2 is that in the embodiment 300 of FIG. 5, the sections of each loop are not placed intertwined or interlaced. Instead, as we see in FIG. 5, one "L" of each loop is placed in parallel with one "L" of the other loop, i.e. the first section 107 of the passive loop is placed in parallel with the first section 103 of the driving loop, and the second section 108 of the passive loop is placed in parallel with the second section 105 of the driving loop, with both sections 107, 108, of the passive loop being on the same side of the sections 103, 105 of the active loop. In FIG. 5, the sections of the active loop are placed on the outside of the sections of the passive loop, but this could have been the other way around as well, i.e. the sections of the active loop could have been placed on the inside of the sections of the passive loop.

We see that the embodiment 300 also comprises the phase shifters which shift the phase from the driving loop to the passive loop. As explained in connection to FIGS. 1 and 2, in the embodiments 300 of FIG. 5, this is not necessary, but is used in order to obtain a desired polarization, in this case linear polarization, for which reason the phase shifters 111, 114, shift the phase 0° or 180° between the two loops. As with the embodiment 200 of FIG. 2, the phase shifters 111, 114, of FIG. 5 can also comprise amplifiers which amplify from the active loop to the passive loop, or such amplifiers can be arranged separately from the phase shifters 111, 114.

Figure 6:
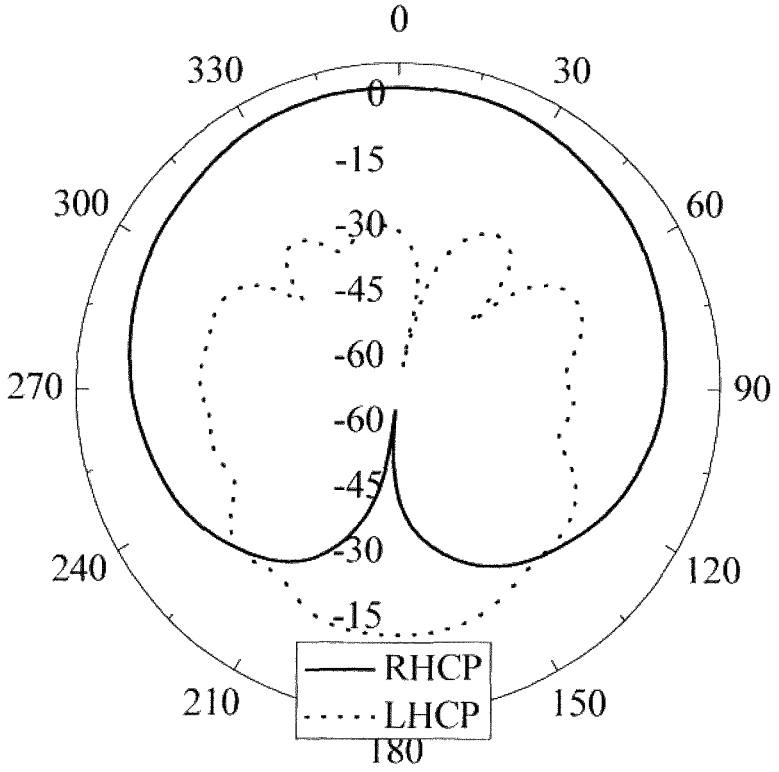
FIGS. 6-9 shows performance graphs of the active antenna of FIG. 2, and FIGS. 10-12 show embodiments of components for use in the active antenna of FIGS. 1, 2 and 5.
Figure 7:
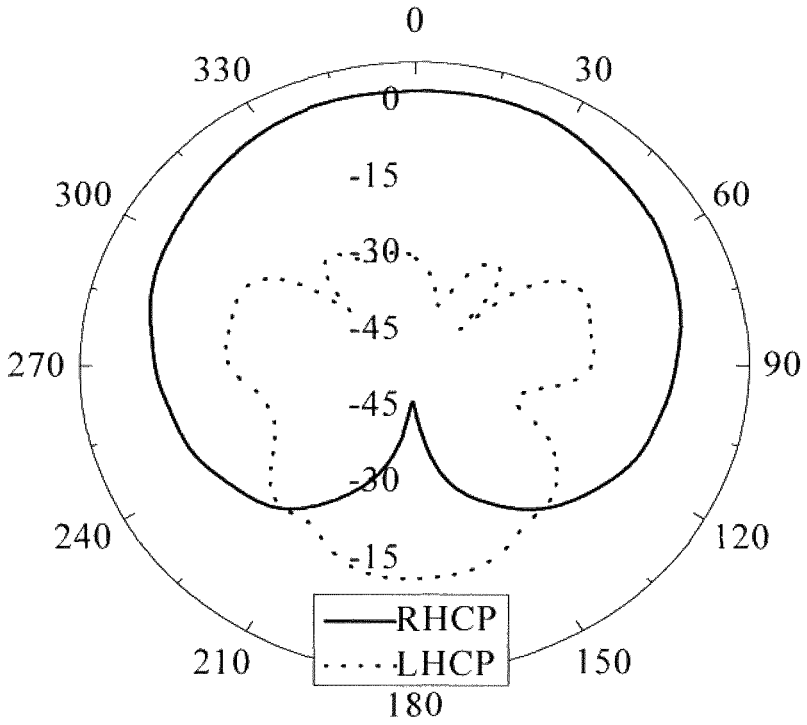

Turning now to the performance of the active antenna, the active antenna 200 of FIG. 2 was, in one example, built as follows: the active antenna was implemented on a substrate with a thickness of 200 um and a permittivity of 5.9. The width of transmission line (i.e. the "L"s) is 40 um, and the length of fold arm (i.e. the legs of the "L"s) is 890 um. The backside of the substrate is a metal layer as a ground plane. The performance of this active antenna is shown in FIGS. 6-9: FIGS. 6 and 7 show the radiation patterns on planes $\phi=0°$ (FIG. 6) and 90° (FIG. 7), where $\phi$ denotes the azimuth angle. As we can see, the active antenna features vertical beams in the "broadside direction" with less than −30 dB cross polarization. (RHCP: Right Handed Cross Polarization; LHCP: Left Handed Cross Polarization).

Figure 8:
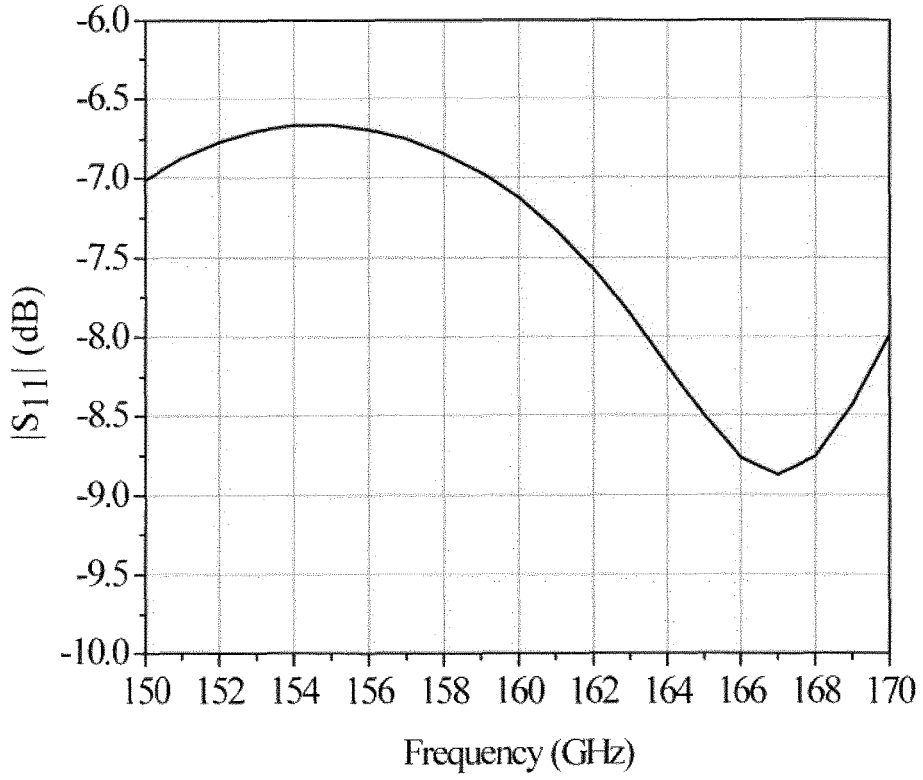

FIG. 8 illustrates the reflection coefficient $|S_{11}|$ of the active antenna 200 in the frequency range from 150 to 170 GHz.

Figure 9:
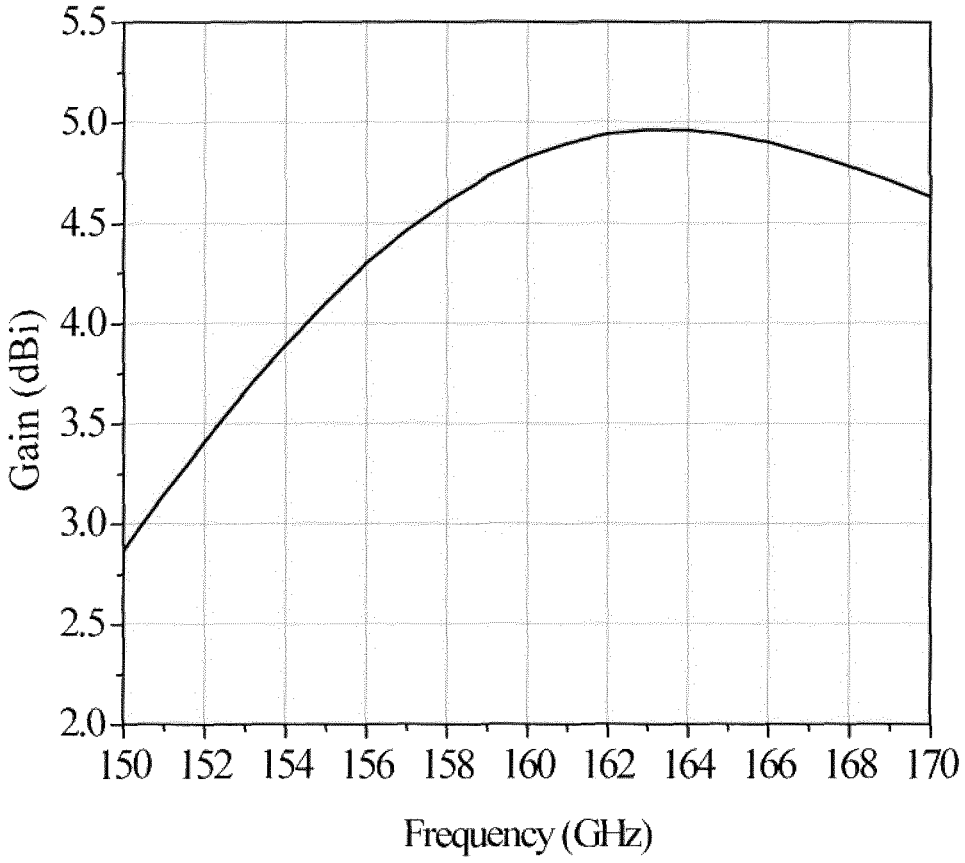

In FIG. 9, we see the antenna gain (as dBi) in the interval 150-170 GHz: we see that the maximum gain of 5 dBi appears at 163 GHz.

FIG. 10 shows an example of an embodiment of a reflection amplifier for use as the reflection amplifiers 101, 102 and 104 of FIGS. 1 and 2. The amplifier shown in FIG. 9 is labeled as 101 in FIG. 9, but can thus be used as the amplifiers 102 and 104 as well.

The amplifier 106 is also a reflection amplifier, but since it is also provided with input/output ports, a modification of the design shown in FIG. 9 is suitably used, which will also be described in the following.

As we see in FIG. 9, the reflection amplifier 900 comprises two transistors 15 and 16. The transistors are shown as bipolar junction transistors, but they can also be replaced by FET transistors, in a manner which will be obvious to those skilled in the art. This observation (FET transistors instead of bipolar junction transistors) is also valid for the designs shown in FIGS. 10 and 11.

As shown in FIG. 9, the base of each of the transistors 15, 16 is connected with the collector of the other transistor via a DC decoupling capacitors 13, 14. In addition, the base of each transistor 15, 16, is connected to a control voltage $V_c$ via respective inductors 10, 11, which act as AC chokes. The base of each transistor is also connected to a base bias voltage $V_b$ via respective resistances 17, 18. The emitter of each transistor is grounded, i.e. connected to a common ground.

The collectors of the two transistors are also used as input/output ports of the amplifier 101, where input signals at the collector of transistor 15 will be amplified by the transistor 16, and will then be accessible at the collector of transistor 16. In the same way, input signals at the collector of transistor 16 will be amplified by the transistor 15 and be accessible at the collector of transistor 15. The gain of the differential amplifier is determined mainly by the base bias voltage $V_b$ and the transistors' characteristics.

Figure 11:
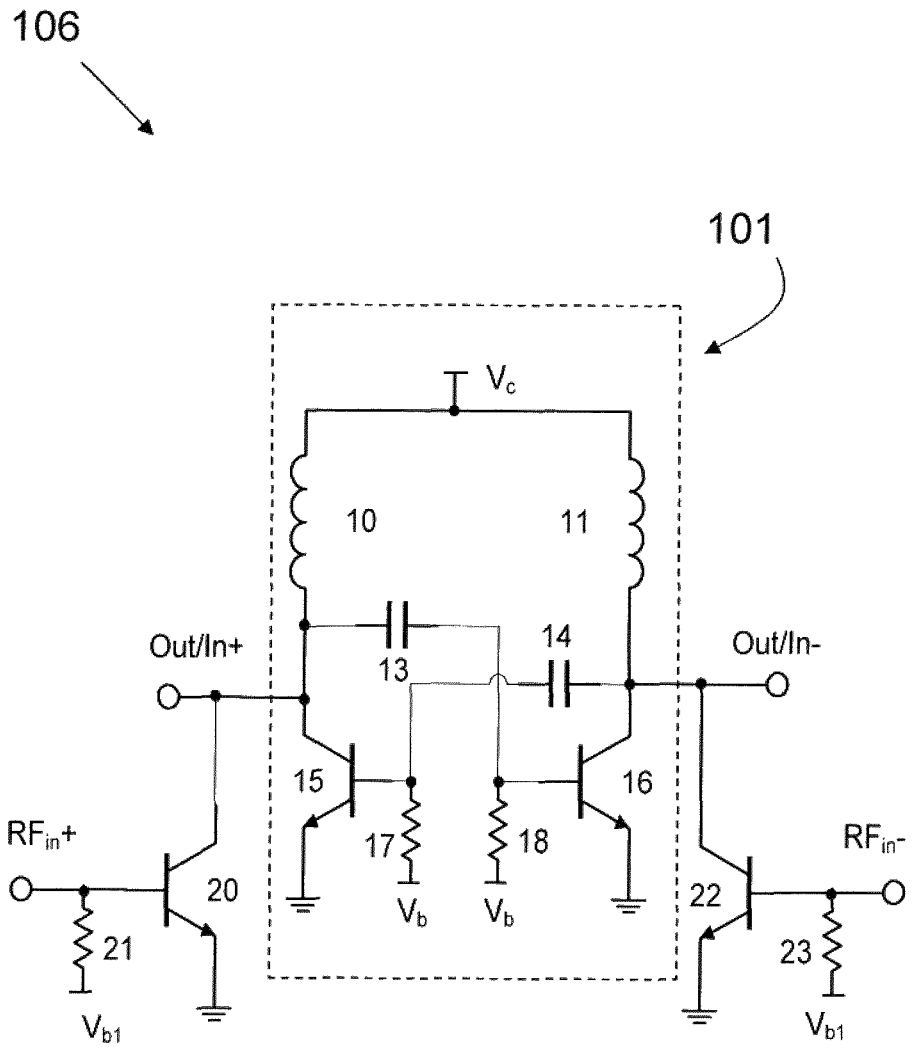

FIG. 11 shows how the embodiment of the reflection amplifier 101 from FIG. 10 can be modified for use as a reflection amplifier with differential input/output ports, thereby making it suitable for use as the reflection amplifier 106 of FIGS. 1, 2 and 5. The reflection amplifier 101 from FIG. 10 which forms part of the reflection amplifier 106 is shown in FIG. 11 by means of a dashed rectangle, and will not be described in detail again here.

As compared to the reflection amplifier 101, the reflection amplifier 106 comprises two additional transistors, 20 and 22, the collector of one of which is connected to the collector to one of the transistors 15, 16, and the emitters of which are connected to the ground as are the emitters of the transistors 15, 16. The collectors of the transistors 20, 22, are used as the input/output ports by means of which the reflection amplifier 106 is used to connect two end points of the sections 103, 105, of the driving loop, and the bases of the two transistors 20, 22 are used as the differential input/output ports by means of which signals are fed to/accessed from the active antenna 100, 200. The bases of the transistors are also connected to a bias voltage $V_{b1}$ via respective resistors 21, 23.

Figure 12:
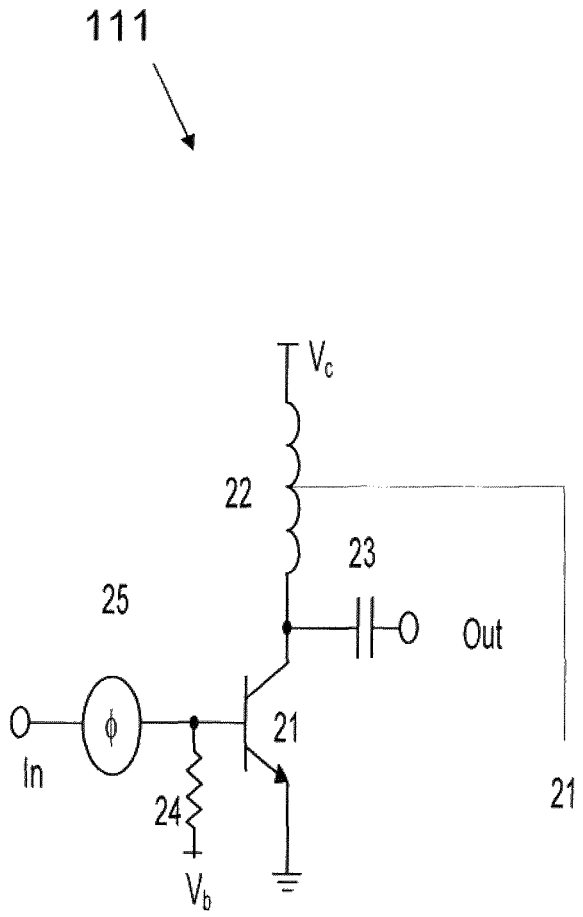

FIG. 12 shows an example of an embodiment of an amplifier 111 with a phase shifter for use as the component 111 or 113 of FIGS. 1, 2 and 5 in the cases where the amplifier is equipped with a phase shifter. If it is not desired to have an amplifier and a phase shifter, the phase shifter shown in FIG. 11 can be omitted, and the rest of the design will still be valid.

As shown in FIG. 11, there is comprised a transistor 21, which has its emitter connected to ground and has its collector connected to a decoupling capacitor 23, via which output signals are accessed, i.e. the collector is used as an output port via the capacitor 23. The collector is also connected to a control voltage Vc via an inductor 22, which acts as an AC choke. The input port of the amplifier 111 is connected to the base of the transistor 21, suitably via a phase shifter 25 in applications in which such a phase shift is desired. The phase shifter 25 is shown as being a 90° phase shifter, which is naturally an example only. The base bias voltage $V_b$ of the transistor 21 is also connected to base via a resistor 24, and the emitter of the transistor 21 is connected to the common ground.

In the drawings and specification, there have been disclosed exemplary embodiments of the invention. However, many variations and modifications can be made to these embodiments without substantially departing from the principles of the present invention. Accordingly, although specific terms are employed, they are used in a generic and descriptive sense only and not for purposes of limitation.

The invention claimed is:

1. An active antenna, comprising:

a driving loop with a first section and a second section, each of the sections of the driving loop extending between two respective end points, with each end point of each section of the driving loop being electrically connected to the closest end point of the other section of the driving loop via a reflection amplifier of a first plurality of reflection amplifiers, wherein one of the reflection amplifiers of the first plurality of reflection amplifiers comprises differential input/output ports for signals to/from the active antenna; and a passive loop with a first section and a second section, each of the sections of the passive loop extending between two respective end points, with each end point of each section of the passive loop being electrically connected to the closest end point of the other section of the passive loop by means of a reflection amplifier of a second plurality of reflection amplifiers, wherein each reflection amplifier of the second plurality of reflection amplifiers has a higher gain than the reflection amplifiers of the first plurality of reflection amplifiers, which connect the sections of the driving loop, wherein the driving loop and the passive loop extend in parallel to each other, and wherein the first section and the second section of each of the loops form separated complementary parts of a closed geometrical shape and are built in open waveguide technology.

2. The active antenna of claim 1, wherein the sections of the driving loop are located on alternating sides of the sections of the passive loop, such that, for each section of the driving loop, one part of that section of the driving loop is disposed on the outside of one of the sections of the passive loop and another part of that section of the driving loop is disposed on the inside of the other section of the passive loop.

3. The active antenna of claim 1, wherein the two sections of the driving loop are located on the same side of the two sections of the passive loop.

4. The active antenna of claim 1, wherein the driving loop and the passive loop are configured to have their signals in-phase or to have a phase difference of 180° between their signals.

5. The active antenna of claim 1, wherein the driving loop and the passive loop are arranged to have a phase difference of 90° between their signals.

6. The active antenna of claim 1, wherein the driving loop and the passive loop are connected to each other by:

a first amplifier which connects the first sections of the two loops; and a second amplifier which connects the second sections of the two loops.

7. The active antenna of claim 6, wherein the first and the second amplifiers both are configured to amplify in a direction from the driving loop to the passive loop.

8. The active antenna of claim 6, wherein the first and the second amplifiers both are configured to amplify in a direction from the passive loop to the driving loop.

9. The active antenna of claim 6, wherein the first and the second amplifiers are configured to amplify in different directions, such that one of the amplifiers is configured to amplify from the driving loop to the passive loop and the other amplifier is configured to amplify from the passive loop to the driving loop.

10. The active antenna of claim 1, wherein the first and second sections of both the first and second loops are all L-shaped, such that each section has two legs.

11. The active antenna of claim 10, wherein the two legs of the first and second sections of the first loop are of equal lengths.

12. The active antenna of claim 11, wherein the two legs of the first and second sections of the second loop are of equal lengths.

* * * * *